US010349683B2

(12) United States Patent
Macko et al.

(10) Patent No.: US 10,349,683 B2
(45) Date of Patent: Jul. 16, 2019

(54) ELECTRONIC SMOKING ARTICLE

(71) Applicant: Altria Client Services LLC, Richmond, VA (US)

(72) Inventors: Jason Andrew Macko, Richmond, VA (US); James Anthony Skapars, Richmond, VA (US)

(73) Assignee: Altria Client Services LLC, Richmond, VA (US)

( * ) Notice: Subject to any disclaimer, the term of this patent is extended or adjusted under 35 U.S.C. 154(b) by 0 days.

(21) Appl. No.: 15/997,324

(22) Filed: Jun. 4, 2018

(65) Prior Publication Data

US 2018/0279686 A1 Oct. 4, 2018

Related U.S. Application Data

(63) Continuation of application No. 14/185,299, filed on Feb. 20, 2014, now Pat. No. 9,986,760.

(60) Provisional application No. 61/768,080, filed on Feb. 22, 2013.

(51) Int. Cl.
*A24F 47/00* (2006.01)

(52) U.S. Cl.
CPC ..... *A24F 47/008* (2013.01)

(58) Field of Classification Search
CPC ..... A24F 47/008
See application file for complete search history.

(56) References Cited

U.S. PATENT DOCUMENTS

| | | | |
|---|---|---|---|
| 4,091,264 | A | 5/1978 | Sarcia |
| 4,617,232 | A | 10/1986 | Chandler et al. |
| 4,995,547 | A | 2/1991 | Schubert et al. |
| 5,018,259 | A | 5/1991 | Wildman |
| 5,595,706 | A | 1/1997 | Sikka et al. |
| 5,649,554 | A | 7/1997 | Sprinkel et al. |
| 5,878,752 | A | 3/1999 | Adams et al. |
| 6,627,116 | B1 | 9/2003 | Suda et al. |
| 8,794,231 | B2 | 8/2014 | Thorens et al. |
| 2003/0000486 | A1 | 1/2003 | Ott et al. |
| 2005/0016549 | A1 | 1/2005 | Banerjee et al. |
| 2006/0193981 | A1 | 8/2006 | Wheat et al. |
| 2009/0272379 | A1 | 11/2009 | Thorens et al. |
| 2009/0308795 | A1 | 12/2009 | Smith |
| 2010/0272421 | A1 | 10/2010 | Liu et al. |

(Continued)

FOREIGN PATENT DOCUMENTS

| | | | |
|---|---|---|---|
| CN | 1045691 | A | 10/1990 |
| CN | 1205849 | A | 1/1999 |

(Continued)

OTHER PUBLICATIONS

Chinese Office Action dated Oct. 8, 2018 for corresponding Chinese Patent Application No. 201480010152.8.

(Continued)

*Primary Examiner* — Eric Yaary

(74) *Attorney, Agent, or Firm* — Harness, Dickey & Pierce, P.L.C.

(57) ABSTRACT

An electronic smoking article includes a liquid supply region including liquid material and a heater-wick element operable to wick liquid material and heat the liquid material to a temperature sufficient to vaporize the liquid material and form an aerosol. The heater-wick element comprises a plurality of fused metal beads or particles.

10 Claims, 2 Drawing Sheets

(56) References Cited

U.S. PATENT DOCUMENTS

| | | | | |
|---|---|---|---|---|
| 2011/0226236 | A1 | 9/2011 | Buchberger | |
| 2011/0253798 | A1 | 10/2011 | Tucker et al. | |
| 2012/0024837 | A1 | 2/2012 | Thompson | |
| 2012/0255567 | A1 | 10/2012 | Rose et al. | |
| 2012/0260927 | A1 | 10/2012 | Liu | |
| 2012/0285475 | A1* | 11/2012 | Liu | A24F 47/008 131/329 |
| 2013/0228191 | A1 | 9/2013 | Newton | |
| 2013/0255702 | A1 | 10/2013 | Griffith, Jr. et al. | |
| 2013/0306065 | A1 | 11/2013 | Thorens et al. | |
| 2014/0000638 | A1 | 1/2014 | Sebastian et al. | |
| 2014/0020693 | A1 | 1/2014 | Cochand et al. | |
| 2014/0060555 | A1 | 3/2014 | Chang et al. | |

FOREIGN PATENT DOCUMENTS

| | | | | |
|---|---|---|---|---|
| CN | 1345529 | A | 4/2002 | |
| CN | 201379072 | Y | 1/2010 | |
| CN | 101878958 | A | 11/2010 | |
| CN | 201767029 | U | 3/2011 | |
| CN | 201830900 | U | 5/2011 | |
| CN | 102264420 | A | 11/2011 | |
| CN | 202354377 | U | 8/2012 | |
| CN | 202456410 | U | 10/2012 | |
| EP | 0358002 | A2 | 3/1990 | |
| EP | 2340729 | A1 | 7/2011 | |
| EP | 2460423 | A1 | 6/2012 | |
| EP | 2460424 | A1 | 6/2012 | |
| EP | 2468117 | A1 | 6/2012 | |
| RU | 94815 | U1 | 6/2010 | |
| RU | 2009107275 | A | 9/2010 | |
| RU | 103062 | U1 | 3/2011 | |
| RU | 103281 | U1 | 4/2011 | |
| RU | 121706 | U1 | 11/2012 | |
| WO | WO-0303487 | A1 | 1/2003 | |
| WO | WO-03/034847 | | 5/2003 | |
| WO | WO-2009/132793 | A1 | 11/2009 | |
| WO | WO-2011124033 | A1 * | 10/2011 | A24F 47/008 |

OTHER PUBLICATIONS

International Search Report dated May 28, 2014.
U.S. Office Action dated May 25, 2016 issued in co-pending U.S. Appl. No. 14/185,230.
U.S. Office Action dated Mar. 31, 2016 issued in co-pending U.S. Appl. No. 14/185,259.
International Preliminary Report on Patentability dated Feb. 22, 2013 issued in corresponding PCT Application No. PCT/US2014/017593.
International Search Report PCT/ISA/210 for International Application No. PCT/US2014/017593 dated Feb. 22, 2013.
Written Opinion of the International Searching Authority PCT/ISA/237 for International Application No. PCT/US2014/017593 dated Feb. 22, 2013.
International Search Report PCT/ISA/210 for International Application No. PCT/US2014/017438 dated Feb. 20, 2014.
U.S. Office Action dated Jul. 15, 2016 issued in co-pending U.S. Appl. No. 14/185,259.
Kazakhstan Office Action dated Nov. 7, 2016 issued in corresponding Kazakhstan Application No. 2015/1042.1.
Kazakhstan Office Action dated Nov. 16, 2016 issued in corresponding Kazakhstan Application No. 2015/1044.1.
Kazakhstan Office Action dated Nov. 16, 2016 issued in corresponding Kazakhstan Application No. 2015/1043.1.
European Office Action dated Dec. 5, 2016 issued in corresponding European Patent Application No. 14708441.2.
Chinese Office Action dated Mar. 1, 2017 issued in corresponding Chinese Patent Application No. 21480010167.4 (English translation provided).
Chinese Office Action dated Mar. 8, 2017 issued in corresponding Chinese Patent Application No. 21480010152.8 (English translation provided).
Chinese Office Action dated Mar. 28, 2017 issued in corresponding Chinese Patent Application No. 201480010181.4.
Chinese Office Action dated Mar. 8, 2017 issued in corresponding Chinese Patent Application No. 201480010152.8.
European Examination Report dated Aug. 7, 2017 for European Application No. EP 14 708 441.2.
Third Party Observation dated May 19, 2017 for European Application No. EP 14 708 441.2.
Chinese Office Action corresponding to Chinese Application No. 201480010152.8 dated Aug. 14, 2017 and English translation.
U.S. Office Action dated Oct. 16, 2017 issued in co-pending U.S. Appl. No. 14/185,259.
Office Action for corresponding Russian Application No. 2015140108 dated Oct. 25, 2017 and English translation thereof.
Examination Report for corresponding European Application No. 14709069.0 dated Feb. 27, 2018.
Examination Report for corresponding European Application No. 14708434.7 dated Feb. 27, 2018.
Office Action for corresponding Russian Application No. 2015140078 dated Feb. 16, 2018 and English translation thereof.
Office Action for corresponding Russian Application No. 2015014077 dated Mar. 16, 2018 and English translation thereof.
Ukrainian Office Action for corresponding Ukrainian Application No. A 2015 08992 dated Mar. 3, 2018 and English translation thereof.
European Office Action for corresponding European Application No. 14708441.2 dated Apr. 3, 2018.
Chinese Office Action for corresponding Chinese Application No. 201480010152.8 dated Mar. 21, 2018 and English translation thereof.
U.S. Office Action dated Oct. 22, 2018 for corresponding U.S. Appl. No. 15/991,250.
Substantive Examination Adverse Report for corresponding Malaysian Application No. PI 2015002073 dated Oct. 31, 2018.
Substantive Examination Adverse Report for corresponding Malaysian Application No. PI 2015002092 dated Nov. 15, 2018.
Substantive Examination Adverse Report for corresponding Malaysian Application No. PI 2015002077 dated Apr. 15, 2019.
Examination Report for corresponding Indian Application No. 5074/CHENP/2015 dated Apr. 23, 2019.

* cited by examiner

ELECTRONIC SMOKING ARTICLE

CROSS-REFERENCE TO RELATED APPLICATIONS

This application is a continuation under 35 U.S.C. § 120 of U.S. application Ser. No. 14/185,299, filed Feb. 20, 2014, which claims priority under 35 U.S.C. § 119(e) to U.S. Provisional Application No. 61/768,080, filed on Feb. 22, 2013, the entire contents of each of which are incorporated herein by reference.

SUMMARY

An electronic smoking article is provided which includes a heater-wick element which wicks liquid and heats the liquid material to produce an aerosol or "vapor." The heater-wick element preferably comprises a plurality of metal beads or particles fused together into a frit of a desired shape. The heater-wick element includes a wicking portion and a heatable portion, which are integrally formed.

DETAILED DESCRIPTION

Figure 1:
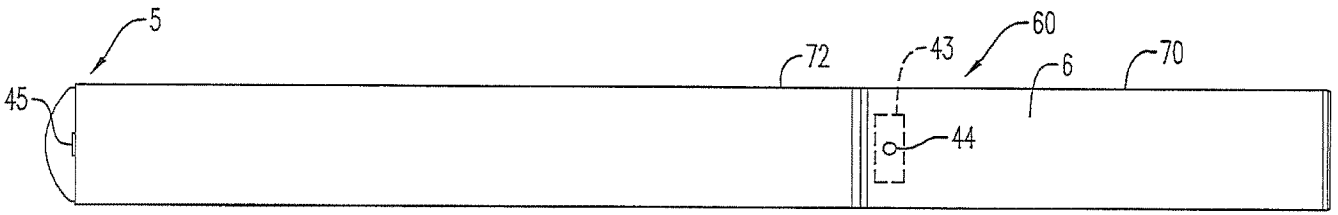
FIG. 1 is a top planar view of an electronic smoking article according to a first embodiment.
Figure 2:
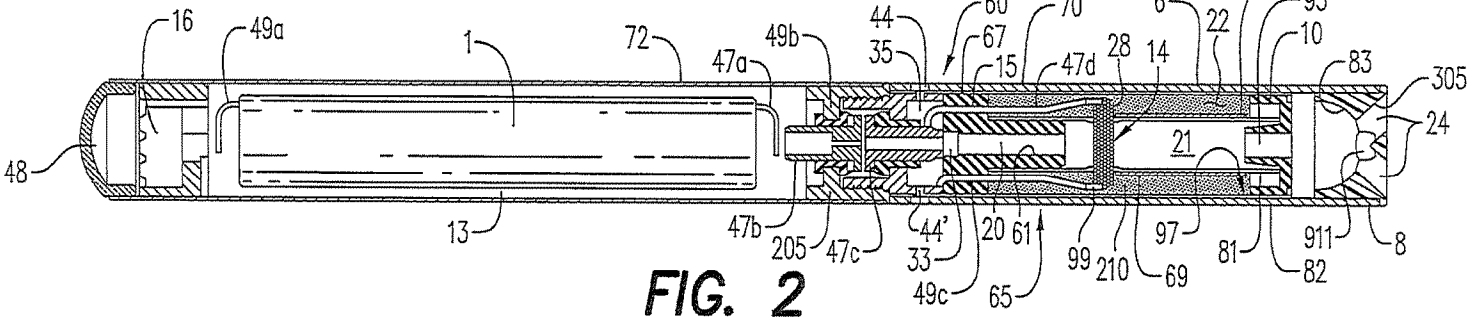
FIG. 2 is a side cross-sectional view of the electronic smoking article shown in FIG. 1 including a heater-wick element as described herein.

Referring to FIGS. 1 and 2, an electronic smoking article (article) 60 is provided and comprises a replaceable cartridge (or first section) 70 and a reusable fixture (or second section) 72, which in the preferred embodiment are coupled together at a threaded connection 205 or by other convenience such as a snug-fit, detent, clamp and/or clasp. Generally, the second section 72 includes a puff sensor 16 responsive to air drawn into the second section 72 via an air inlet port 45 adjacent the free end or tip of the smoking article 60, a battery 1 and control circuitry. The disposable first section 70 includes a liquid supply region of 22 including liquid and a heater-wick element 14 that wicks liquid from the liquid supply region 22 and heats the liquid to form an aerosol in a central air channel 21. Upon completing the threaded connection 205, the battery 1 is electrically connected with the heater-wick element 14 of the first section 70 upon actuation of the puff sensor. Air is drawn primarily into the first section 70 through one or more air inlets 44.

In the preferred embodiment, once the liquid of the cartridge is spent, only the first section 70 is replaced. An alternate arrangement includes a layout where the entire article 60 is disposed once the liquid supply region is depleted. In such case the battery type and other features might be engineered for simplicity and cost-effectiveness, but generally embodies the same concepts as in the preferred embodiment in which the second section is reused and/or recharged.

In a preferred embodiment, the electronic smoking article 60 is about the same size as a conventional smoking article.

In some embodiments, the electronic smoking article 60 can be about 80 mm to about 110 mm long, preferably about 80 mm to about 100 mm long and about 7 mm to about 8 mm in diameter. For example, in a preferred embodiment, the electronic smoking article is about 84 mm long and has a diameter of about 7.8 mm.

Preferably, at least one adhesive-backed label is applied to the outer tube 6. The label completely circumscribes the electronic smoking article 60 and can be colored and/or textured to provide the look and/or feel of a traditional smoking article. The label can include holes therein which are sized and positioned so as to prevent blocking of the air inlets 44.

The first section 70 includes an outer tube (or casing) 6 extending in a longitudinal direction and an inner tube (or chimney) 62 coaxially positioned within the outer tube 6. Preferably, a nose portion 61 of an upstream gasket (or seal) 15 is fitted into an upstream end portion 65 of the inner tube 62, while at the same time, an outer perimeter 67 of the gasket 15 provides a liquid-tight seal with an interior surface of the outer casing 6. The upstream gasket 15 also includes a central, longitudinal air passage 20, which opens into an interior of the inner tube 62 that defines a central channel 21. A transverse channel 33 (shown in FIG. 2) at a backside potion of the gasket 15 intersects and communicates with the central channel 20 of the gasket 15. This channel 33 assures communication between the central channel 20 and a space 35 (see FIG. 2) defined between the gasket 15 and a cathode connector piece 37. In the preferred embodiment, the piece 37 includes a threaded section for effecting the threaded connection 205.

The outer tube 6 and/or the inner tube 62 may be formed of any suitable material or combination of materials. Examples of suitable materials include metals, alloys, plastics or composite materials containing one or more of those materials, or thermoplastics that are suitable for food or pharmaceutical applications, for example polypropylene, polyetheretherketone (PEEK), ceramic, and polyethylene. Preferably, the material is light and non-brittle.

In the preferred embodiment, as shown in FIGS. 1 and 2, the electronic smoking article 60 includes at least one air inlet 44 formed in the outer tube 6, preferably adjacent to the threaded connection 205 to minimize the chance of a smoker's fingers occluding one of the inlets and to control the resistance to draw (RTD) during smoking. In the preferred embodiment, the air inlets 44, 44' are sized and configured such that the electronic smoking article 60 has a RTD in the range of from about 60 mm $H_2O$ to about 150 mm $H_2O$, more preferably about 90 mm $H_2O$ to about 110 mm $H_2O$, most preferably about 100 mm $H_2O$ to about 130 mm $H_2O$.

In the preferred embodiment, the second section 72, includes an air inlet 45 at an upstream end 5 of the smoking article 60, which is sized just sufficient to assure proper operation of the puff sensor 16, located nearby. Drawing action upon the mouth end insert 8 is communicated to the air inlet port 45 through central channels provided in the anode post 47*c* of the first section 70 and the anode connection post 47*b* of the second section 72 and along space 13 between the battery 1 and the casing of the second section 72. The air inlet port 45 is sized such that the airflow rate therethrough is much smaller than the airflow rates through the air inlets 44, 44', so that the impact on RTD is minimized and consistency in RTD is maintained. For example, each air inlet 44, 44' can be less than about 2.0 mm in width and less than about 1.5 mm in length.

Preferably, a nose portion 93 of a downstream gasket 10 is fitted into a downstream end portion 81 of the inner tube 62. An outer perimeter 82 of the gasket 10 provides a substantially liquid-tight seal with an interior surface 97 of the outer casing 6. The downstream gasket 10 includes a central channel 93 disposed between the central passage 21 of the inner tube 62 and the interior of the mouth end insert 8 and which communicates aerosol from the central passage 21 to the mouth end insert 8.

In the preferred embodiment, the liquid supply region 22 is contained in an outer annulus between inner tube 62 and outer tube 6 and between the gaskets 10 and 15. Thus, the liquid supply region 22 at least partially surrounds the central air passage 21. The liquid supply region 22 comprises a liquid material and optionally a liquid storage medium operable to store the liquid material therein.

Preferably, the liquid storage medium is a fibrous material comprising cotton, polyethylene, cellulose, cellulose acetate, polyester, rayon and combinations thereof. Preferably, the fibers have a diameter ranging in size from about 6 microns to about 15 microns (e.g., about 8 microns to about 12 microns or about 9 microns to about 11 microns). The liquid storage medium can be a fibrous, sintered, porous, sponge, or foamed material. Also preferably, the fibers are sized to be irrespirable and can have a cross-section which has a round and/or hollow, y shape, cross shape, clover shape or any other suitable shape. In one embodiment, the liquid storage medium may comprise a winding of cotton gauze or other fibrous material about the inner tube 62. In the alternative, the liquid supply region 22 may comprise a filled tank lacking a fibrous storage medium and containing only liquid material.

Also preferably, the liquid material has a boiling point suitable for use in the electronic smoking article 60. If the boiling point is too high, the heater-wick element 14 will not be able to vaporize the liquid. However, if the boiling point is too low, the liquid may vaporize even when the heater-wick element 14 is not activated.

Preferably, the liquid material includes a tobacco-containing material including volatile tobacco flavor compounds which are released from the liquid upon heating. The liquid may also be a tobacco flavor containing material or a nicotine-containing material. Alternatively, or in addition, the liquid may include a non-tobacco material and/or a nicotine-free material. For example, the liquid may include water, solvents, ethanol, plant extracts and natural or artificial flavors. Preferably, the liquid further includes an aerosol former. Examples of suitable aerosol formers are glycerine and propylene glycol.

In use, liquid material is transferred from the liquid supply region 22 and/or liquid storage medium via the heater-wick element 14, which includes at least one wicking portion 140 and a heatable portion 141. In the preferred embodiment, the heater-wick element 14 includes two wicking portions 140 and a heatable portion 141 therebetween. Also preferably, the wicking portions 140 and the heatable portion 141 are integrally formed of the same material. Thus, the heater-wick element 14 is a single piece of material.

Advantageously, the heater-wick element 14 serves as both a wicking medium and a heating element. Thus, the heater-wick element 14 is a single piece structure and there is no need for a separate wick and heater. As such, the heater-wick element 14 is easy to manufacture and inexpensive as compared to electronic smoking articles including a separate heater and wick. Moreover, electricity flowing through the heater-wick element 14 can heat the heater-wick element via electrical resistance thereby heating the liquid material and lowering the viscosity of the liquid material, which can improve the flow of the liquid material from the wicking portions to the heatable portions of the heater-wick element.

Figure 3:
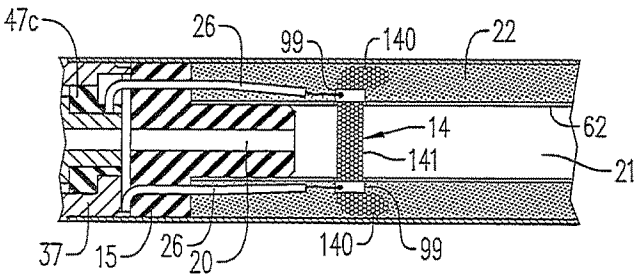
FIG. 3 is an enlarged view of the heater-wick element of FIG. 2.

As shown in FIGS. 2 and 3, the heater-wick element 14 includes a plurality of small metal beads or particles that have been fused (sintered) together. In an alternative embodiment, the beads or particles can be glued together with a ceramic paste or other temperature resistant and potentially electrically conductive substance. The glue need not be electrically conductive. Each bead or particle is of a sub-millimeter diameter. Because a plurality of small metal beads or particles are fused together to form the heater-wick element 14, the heater-wick element 14 includes internal cavities through which liquid material can travel by capillary action.

As used herein, the term "particle" refers to beads, bits, rods, granules, powder, and pieces of any shape that can be fused together to form the heater-wick element 14 described herein.

The heater-wick element 14 can be formed as a rod, a spiral, a block, a cylinder or a ribbon of metal beads or particles. Preferably, the heater-wick element 14 is substantially rigid. Moreover, the rod or ribbon can be straight, curved, or otherwise shaped to fit within the electronic cigarette.

For example, the heater-wick element 14 can be U-shaped such that the heatable portion 141 is substantially straight and the wicking portions 140 extend upwardly or downwardly into the liquid supply region 22, as shown in FIG. 3. To position irregularly shaped heater-wick elements 14, a slit can be made in each side of the inner tube 62 and extending to each slot. The heater-wick element 14 can be slid into place such that the heater-wick element 14 extends across the central air passage 21 and into the liquid supply region 22.

Figure 5:
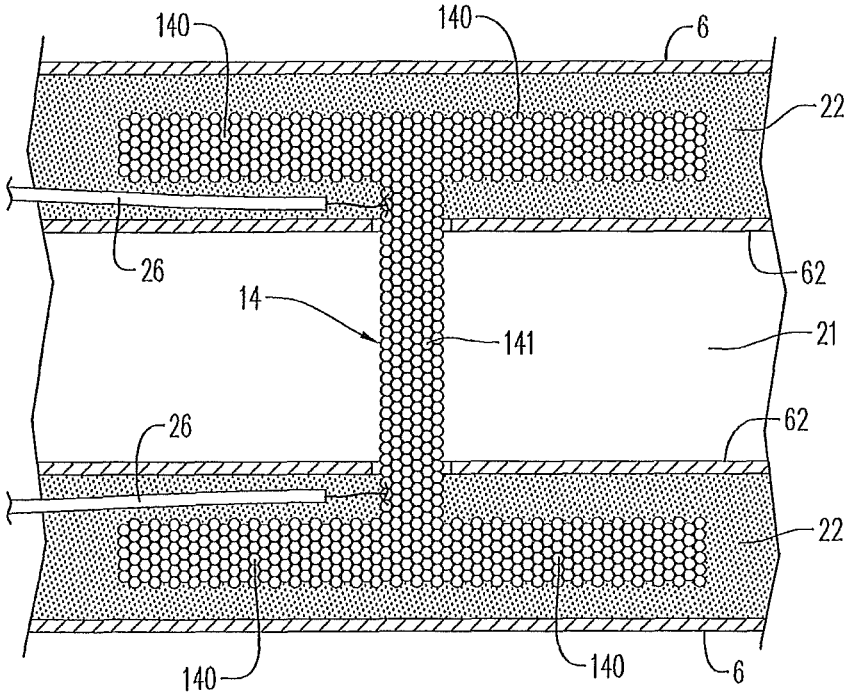
FIG. 5 is an enlarged view of another embodiment of a heater-wick element.

In another embodiment, as shown in FIG. 5, the heater-wick element 141 can be H-shaped. The H-shaped heater-wick element 14 can include four wicking portions 140 extending into the liquid supply region and a heatable portion 141 extending across the central channel 21 of the inner tube 62. Advantageously, an H-shaped heater-wick element 14 facilitates capillary draw of the liquid due to the use of four wicking portions 140.

Preferably, the heater-wick element 14 is substantially uniform in diameter and/or width at least along the heatable portion 141 of the heater-wick element 14. Such uniformity promotes even heating. Alternatively, the heater-wick element 14 can vary in diameter and/or width along the length thereof so as to alter the heating profile of the heater-wick element 14.

As shown, the heater-wick element 14 can extend across the central channel 21 between opposing portions of the liquid supply region 22 and into the liquid supply region 22. Thus, the wicking portion 140 at each end of the heater-wick element 14 extends through slots in the inner tube 62 and into the liquid supply region 22 so as to wick liquid into the heatable portion 141 of the heater-wick element 14, which is positioned within the central air passage 21. A closure ring can slide over an outer surface of the inner tube so as to substantially close off a remainder of open space provided between the heater-wick element and the slot, as described in U.S. Patent Application Publication No. 2013/0192619 filed Jan. 14, 2013, the entire content of which is incorporated herein by reference thereto.

Preferably, the heater-wick element 14 is formed of a plurality of small metal beads or particles. Also preferably, the metal is an electrically conductive metal and the heater-wick element 14 is capable of withstanding repeated heating up to at least about 600° C. The size of the metal beads, the packing density of the metal beads and the type of metal are chosen to attain a targeted electrical resistance with high chemical resistance, good heating-induced degradation resistance and a low cost per heater-wick element 14. Moreover, the bead size, density, and porosity can be varied along the length of the heater-wick element to attain a desired wicking and/or heating profile.

Examples of suitable electrically resistive materials include titanium, zirconium, tantalum and metals from the platinum group. Examples of suitable metal alloys include stainless steel, nickel-, cobalt-, chromium-, aluminium-titanium-zirconium-, hafnium-, niobium-, molybdenum-, tantalum-, tungsten-, tin-, gallium-, manganese- and iron-containing alloys, and super-alloys based on nickel, iron, cobalt, stainless steel. For example, the heater-wick element 14 can be formed of nickel aluminides, a material with a layer of alumina on the surface, iron aluminides and other composite materials, the electrically resistive material may optionally be embedded in, encapsulated or coated with an insulating material or vice-versa, depending on the kinetics of energy transfer and the external physicochemical properties required.

Preferably, the heater-wick element 14 comprises at least one material selected from the group consisting of stainless steel, copper, copper alloys, nickel-chromium alloys, super-alloys and combinations thereof. In a preferred embodiment, the heater-wick element 14 is formed of nickel-chromium alloys or iron-chromium alloys.

In another embodiment, the heater-wick element 14 may be constructed of an iron-aluminide (e.g., FeAl or $Fe_3Al$), such as those described in commonly owned U.S. Pat. No. 5,595,706 to Sikka et al., or nickel aluminides (e.g., $Ni_3Al$). Use of iron-aluminides is particularly advantageous in that they exhibit high resistivity. FeAl exhibits a resistivity of approximately 180 micro-ohms, whereas stainless steel exhibits approximately 50 to 91 micro-ohms. The higher resistivity lowers current draw or load on the power source (battery) 1. In other embodiments, the heater-wick element 14 could comprise a metal particles or beads and ceramic particles or beads. In still other embodiments, the heater-wick element 14 is ceramic-free.

Figure 4:
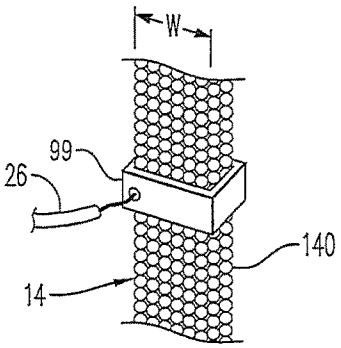
FIG. 4 is an enlarged view of an electrical connection for a heater-wick element as described herein.

Preferably, as shown in FIGS. 2, 3, and 4, a brazed connection region (e.g., a post) 99 formed of a low-resistance material is brazed to each end or at two locations along a portion of the of the heater-wick element 14. Preferably, the brazed connection regions 99 are formed just inside of the inner tube 62 and the heatable portion 141 extends between the brazed connection regions 99. In another embodiment, the brazed connection regions 99 are contained entirely in the outer annulus as shown in FIG. 3. By forming the brazed connection regions 99, the electrical current is uniform across the length and width of heatable region 141 of the heater-wick element 14 so as to avoid hot spots.

For example, the brazed connection region 99 can be formed by wrapping a gold-plated wire around the heater-wick element 14 at select locations and brazing the wire to the heater-wick element 14 at selected locations so as to form a heatable portion 141 between the brazed connection regions 99. Electrical leads 26 are attached to each brazed connection region 99 (or post), as shown in FIG. 4, such that, when voltage is applied by the power supply, the heatable portion 141 heats the liquid material in the heatable portion 141 to a temperature sufficient to at least partially volatilize the liquid and form an aerosol. Alternatively, the electrical leads 26 can be attached directly to the heater-wick element 14 by sintering the electrical lead 26 directly into the heater-wick element 14.

In the preferred embodiment, the heater-wick element 14 is formed of a thermally and/or electrically conductive material. Suitable materials for forming the heater-wick element 14 are selected from the group consisting of stainless steel, copper, copper alloys, Inconel® available from Special Metals Corporation, which is a nickel-chromium alloy, Nichrome®, which is also a nickel-chromium alloy, and combinations thereof.

In a preferred embodiment, the heater-wick element 14 is constructed from a plurality of small metal beads and/or particles each having a diameter of less than about 1 mm, less than about 0.5 mm or less than about 0.25 mm. Preferably, each of the beads or particles is substantially uniform in size. In other embodiment, the beads or particles can vary in size.

The heater-wick element 14 has a length in the range of about 10 mm to about 15 mm, preferably about 12 mm or less, and a width in the range of about 0.5 mm to about 2.0 mm, preferably about 1.5 mm or less. Preferably, the heater-wick element 14 is placed in a transverse direction within the electronic smoking article. In other embodiments, other orientations are possible.

Also preferably, the heater-wick element 14 achieves an electrical resistance ranging from about 0.3 Ohm to about 10 Ohms, more preferably about 0.8 Ohm to about 5.0 Ohms, more preferably about 4.0 Ohms or less.

In addition, liquid can be drawn into the interstices, pores and/or voids between the metal beads and/or particles that form the heater-wick element 14. Thus, the liquid moves along the heater-wick element from the wicking portions 140 to the heatable portion 141. Moreover, the heater-wick element 14 has a porosity of from about 20% to about 80%, more preferably about 30% to about 60% or about 40% to about 50%.

Advantageously, the liquid material in the liquid supply region 22 is protected from oxygen (because oxygen cannot generally enter the liquid supply region 22 via the heater-wick element 14). In some embodiments, the liquid material is also protected from light so that the risk of degradation of the liquid material is significantly reduced. Thus, a high level of shelf-life and cleanliness can be maintained.

In the preferred embodiment, the liquid supply region 22 is sized and configured to hold enough liquid material such that the electronic smoking article 60 is operable for smoking for at least about 200 seconds, preferably at least about 250 seconds, more preferably at least 300 seconds and most preferably at least about 350 seconds. Thus, liquid supply region 22 is equivalent to about one pack of traditional smoking articles. Moreover, the electronic smoking article 60 can be configured to allow each puff to last a maximum of about 5 seconds.

As shown in FIG. 2, the first section 70 can include a mouth end insert 8 having at least two diverging outlets 24 (e.g., 3, 4, 5 or more, preferably 2 to 10 outlets or more, more preferably 6 to 8 outlets, even more preferably 2 to 6 outlets or 4 outlets). Preferably, the outlets 24 are located off-axis and are angled outwardly in relation to the central channel 21 of the inner tube 62 (i.e., divergently). Also preferably, the mouth end insert (or flow guide) 8 includes outlets 24 uniformly distributed about the perimeter of mouth end insert 8 so as to substantially uniformly distribute aerosol in a smoker's mouth during use and create a greater perception of fullness in the mouth. Thus, as the aerosol passes into a smoker's mouth, the aerosol enters the mouth and moves in different directions so as to provide a full mouth feel. In contrast, electronic smoking articles having a single, on-axis orifice tend to direct its aerosol as single jet of greater velocity toward a more limited location within a smoker's mouth.

In addition, the diverging outlets 24 are arranged and include interior surfaces 83 such that droplets of unaerosolized liquid material, if any, that may be entrained in the aerosol impact the interior surfaces 83 of the mouth end insert 8 and/or impact portions of walls 305 which define the diverging outlets 24. As a result such droplets are substantially removed or broken apart, to the enhancement of the aerosol.

In the preferred embodiment, the diverging outlets 24 are angled at about 5° to about 60° with respect to the longitudinal axis of the outer tube 6 so as to more completely distribute aerosol throughout a mouth of a smoker during use and to remove droplets. In a preferred embodiment, there are four diverging outlets 24 each at an angle of about 40° to about 50° with respect to the longitudinal axis of the outer tube 6, more preferably about 40° to about 45° and most preferably about 42°.

Preferably, each of the diverging outlets 24 has a diameter ranging from about 0.015 inch to about 0.090 inch (e.g., about 0.020 inch to about 0.040 inch or about 0.028 inch to about 0.038 inch). The size of the diverging outlets 24 and the number of diverging outlets 24 can be selected to adjust the resistance to draw (RTD) of the electronic smoking article 60, if desired.

The mouth end insert 8 may be integrally affixed within the tube 6 of the cartridge 70. Moreover, the mouth end insert 8 can be formed of a polymer selected from the group consisting of low density polyethylene, high density polyethylene, polypropylene, polyvinylchloride, polyetheretherketone (PEEK) and combinations thereof. The mouth end insert 8 may also be colored if desired.

In the preferred embodiment, the power supply 1 includes a battery arranged in the electronic smoking article 60 such that the anode 47*a* is downstream of the cathode 49*a*. A battery anode post 47*b* of the second section 72 preferably contacts the battery anode 47*a*.

More specifically, electrical connection between the anode 47*a* of the battery 1 and the heater-wick element 14 in the first section 70 is established through a battery anode connection post 47*b* in the second section 72 of the electronic smoking article 60, an anode post 47*c* of the cartridge 70 and an electrical lead 47*d* connecting a rim portion of the anode post 47*c* with the heater-wick element 14. Likewise, electrical connection between the cathode 49*a* of the battery 1 and the other lead of the heater-wick element 14 is established through the threaded connection 205 between a cathode connection fixture 49*b* of the second portion 72 and the cathode connector piece 37 of the first section 70 and from there through an electrical lead 49*c* which electrically connects the fixture 37 to the opposite lead of the heater-wick element 14.

The battery can be a Lithium-ion battery or one of its variants, for example a Lithium-ion polymer battery. Alternatively, the battery may be a Nickel-metal hydride battery, a Nickel cadmium battery, a Lithium-manganese battery, a Lithium-cobalt battery or a fuel cell. In that case, preferably, the electronic smoking article 60 is usable by a smoker until the energy in the power supply is depleted or in the case of lithium polymer battery, a minimum voltage cut-off level is achieved.

Alternatively, the power supply 1 may be rechargeable and include circuitry allowing the battery to be chargeable by an external charging device. In that case, preferably the circuitry, when charged, provides power for a pre-determined number of puffs, after which the circuitry must be re-connected to an external charging device. To recharge the electronic smoking article 60, an USB charger or other suitable charger assembly can be used.

Preferably, the electronic smoking article 60 also includes control circuitry including a puff sensor 16. The puff sensor 16 is operable to sense an air pressure drop and initiate application of voltage from the power supply 1 to the heater-wick element 14. As shown in FIG. 2, the control circuitry can also include a heater activation light 48 operable to glow when the heatable portion 141 of the heater-wick element 14 is activated. Preferably, the heater activation light 48 comprises an LED and is at an upstream end of the electronic smoking article 60 so that the heater activation light 48 takes on the appearance of a burning coal during a puff. Moreover, the heater activation light 48 can be arranged to be visible to the smoker. In addition, the heater activation light 48 can be utilized for smoking article system diagnostics or to indicate that recharging is in progress. The light 48 can also be configured such that the smoker can activate and/or deactivate the light 48 for privacy, such that the light 48 would not activate during smoking if desired.

Preferably, the at least one air inlet 45 (FIG. 1) is located adjacent the puff sensor 16, such that the puff sensor 16 senses air flow indicative of a smoker taking a puff and activates the power supply 1 and the heater activation light 48 to indicate that the heatable portion 141 of the heater-wick element 14 is working.

A control circuit is preferably integrated with the puff sensor 16 and supplies power to the heater-wick element 14 responsive to the puff sensor 16, preferably with a maximum, time-period limiter.

Alternatively, the control circuitry may include a manually operable switch for a smoker to initiate a puff. The time-period of the electric current supply to the heater-wick element may be pre-set depending on the amount of liquid desired to be vaporized. Alternatively, the circuitry may supply power to the heater-wick element 14 as long as the puff sensor 16 detects a pressure drop.

Preferably, when activated, the heater-wick element 14 heats and volatilizes liquid in contact with the heater-wick element 14 for less than about 10 seconds, more preferably less than about 7 seconds. Thus, the power cycle (or maximum puff length) can range in period from about 2 seconds to about 10 seconds (e.g., about 3 seconds to about 9 seconds, about 4 seconds to about 8 seconds or about 5 seconds to about 7 seconds).

When the word "about" is used in this specification in connection with a numerical value, it is intended that the associated numerical value include a tolerance of ±10% around the stated numerical value. Moreover, when reference is made to percentages in this specification, it is intended that those percentages are based on weight, i.e., weight percentages.

Moreover, when the words "generally" and "substantially" are used in connection with geometric shapes, it is intended that precision of the geometric shape is not required but that latitude for the shape is within the scope of the disclosure. When used with geometric terms, the words "generally" and "substantially" are intended to encompass not only features which meet the strict definitions but also features which fairly approximate the strict definitions.

It will now be apparent that a new, improved, and non-obvious electronic smoking article has been described in this specification with sufficient particularity as to be understood by one of ordinary skill in the art. Moreover, it will be apparent to those skilled in the art that numerous modifications, variations, substitutions, and equivalents exist for features of the electronic smoking article which do not materially depart from the spirit and scope of the invention. Accordingly, it is expressly intended that all such modifications, variations, substitutions, and equivalents which fall within the spirit and scope of the invention as defined by the appended claims shall be embraced by the appended claims.

The invention claimed is:

1. An electronic vaping article comprising:

a housing defining an air channel and a liquid supply region, the liquid supply region configured to hold a liquid material; and an integral heater-wick element configured to transfer the liquid material from the liquid supply region to the air channel via capillary action, the integral heater-wick element formed of a plurality of particles and including a heatable portion and at least one wicking portion, the at least one wicking portion extending into the liquid supply region, the heatable portion of the integral heater-wick element extending into the air channel and configured to vaporize the liquid material, the at least one wicking portion including a first wicking portion, a second wicking portion, a third wicking portion, and a fourth wicking portion, the first wicking portion and the second wicking portion disposed at one end of the heatable portion, and the third wicking portion and the fourth wicking portion disposed at an opposing end of the heatable portion.

2. The electronic vaping article of claim 1, wherein the integral heater-wick element has an electrical resistance ranging from about 0.8 Ohm to about 5 Ohms.

3. The electronic vaping article of claim 1, wherein the integral heater-wick element has a porosity ranging from 40% to 50%.

4. The electronic vaping article of claim 1, wherein each of the plurality of particles has a diameter of less than about 0.25 mm.

5. The electronic vaping article of claim 1, wherein the plurality of particles include at least one of metal particles, alloy particles, or coated particles.

6. The electronic vaping article of claim 1, wherein the plurality of particles are formed of at least one of a nickel aluminide or an iron aluminide.

7. The electronic vaping article of claim 1, wherein the air channel extends through the liquid supply region.

8. The electronic vaping article of claim 1, wherein the housing includes an outer tube and an inner tube within the outer tube, the inner tube defining the air channel, the outer tube and the inner tube defining the liquid supply region in between.

9. The electronic vaping article of claim 1, further comprising:

at least one electrical lead connected to the integral heater-wick element, the electrical lead disposed in the liquid supply region.

10. The electronic vaping article of claim 1, wherein the plurality of particles include beads.

* * * * *